US011284732B2

(12) United States Patent
McCloskey, III

(10) Patent No.: US 11,284,732 B2
(45) Date of Patent: Mar. 29, 2022

(54) PARCEL BOX

(71) Applicant: Paul John McCloskey, III, Santa Monica, CA (US)

(72) Inventor: Paul John McCloskey, III, Santa Monica, CA (US)

( * ) Notice: Subject to any disclaimer, the term of this patent is extended or adjusted under 35 U.S.C. 154(b) by 186 days.

(21) Appl. No.: 16/515,806

(22) Filed: Jul. 18, 2019

(65) Prior Publication Data

US 2021/0015286 A1 Jan. 21, 2021

(51) Int. Cl.

*A47G 29/20* (2006.01)
*A47G 29/14* (2006.01)
*A47G 29/22* (2006.01)

(52) U.S. Cl.

CPC ..... *A47G 29/20* (2013.01); *A47G 29/141* (2013.01); *A47G 29/22* (2013.01); *A47G 2029/145* (2013.01)

(58) Field of Classification Search

CPC ..... A47G 29/20; A47G 29/141; A47G 29/16; A47G 29/30; A47G 2029/145; A47G 2029/148; A47G 2029/149; A47G 29/22; B65F 1/16; B65F 1/1623; B65F 1/163; B65F 1/1638

USPC ..... 232/17, 19, 38, 44, 45; 340/568.1, 569; 220/908, 908.1, 908.2, 908.3, 211

See application file for complete search history.

(56) References Cited

U.S. PATENT DOCUMENTS

| | | | | |
|---|---|---|---|---|
| 2007/0103297 | A1* | 5/2007 | Armstrong | G08B 25/00 340/539.22 |
| 2017/0011605 | A1* | 1/2017 | Grabham | A47G 29/30 |
| 2019/0091711 | A1* | 3/2019 | Wang | E03D 11/12 |
| 2019/0167025 | A1* | 6/2019 | Cherry | A47G 29/16 |
| 2019/0231107 | A1* | 8/2019 | Rampton | A47G 29/141 |
| 2019/0270585 | A1* | 9/2019 | Moore | B65F 1/1426 |
| 2019/0350398 | A1* | 11/2019 | Raphael | A47G 29/141 |
| 2020/0077826 | A1* | 3/2020 | Chenier | G07C 9/00309 |
| 2020/0079587 | A1* | 3/2020 | Han | B65F 1/1638 |
| 2020/0207544 | A1* | 7/2020 | Pestl | E05F 15/73 |

* cited by examiner

*Primary Examiner* — William L Miller

(57) ABSTRACT

A parcel box includes a lid, a container, and a self-closing module. The self-closing module is connected to the lid and includes a contacting part arranged inside the container. When a parcel is placed into the container, the contacting part is pushed downward, and the lid-closing module drives the lid to close on the container.

5 Claims, 5 Drawing Sheets

PARCEL BOX

BACKGROUND

Field of Invention

The present invention relates to a parcel box. More particularly, the present invention relates to a parcel box having a mechanism for driving a lid of the parcel box to close when a parcel is placed into a container of the parcel box.

Description of Related Art

Parcels left on porches or at front doors by deliverymen are often left unattended, and are vulnerable to theft and damage. Parcel boxes are used to receive parcels delivered by deliverymen. However, deliverymen are generally not familiar with the parcel boxes, and it is inconvenient for the deliverymen to manually close the lid of the parcel box after placing the parcel therein.

SUMMARY

According to one embodiment of the present disclosure, a parcel box includes a container, a lid, and a lid-closing module. The container has four side walls and a bottom plate. Each of the side walls has a top edge and a bottom edge. The bottom plate is connected to the bottom edges of the side walls, and the four top edges of the side walls define an opening. The bottom edges of the side walls are connected to the bottom plate. The bottom plate and the side walls define a space. The lid has an edge pivotally connected to the top edge of one of the side walls, and is configured to cover the opening at a closed position, and uncover the opening at an open position. The lid-closing module is connected to the lid and includes a contacting part in the space. When the contacting part is pushed toward the bottom plate, the lid-closing module drives the lid to the closed position.

According to another embodiment of the present disclosure, a parcel box includes a container, a lid, a motion sensor, and a motorized unit. The container has four side walls and a bottom plate. Each of the side walls has a top edge and a bottom edge, the bottom plate is connected to the bottom edges of the side walls, and the four top edges of the side walls define an opening. The bottom edges of the side walls are connected to the bottom plate. The bottom plate and the side walls define a space. The lid has an edge pivotally connected to the top edge of one of the side walls, and is configured to cover the opening at a closed position, and uncover the opening at an open position. The motion to sensor is configured to sense a motion of placing an object into the space of the container. The motorized unit is electrically connected to the motion sensor, and is configured to drive the lid to cover the opening when the motion sensor senses the motion.

In the aforementioned embodiments of the present disclosure, because the parcel box has the lid-closing module or the combination of the motion sensor and the motorized unit, the lid of the parcel box can be driven to close.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
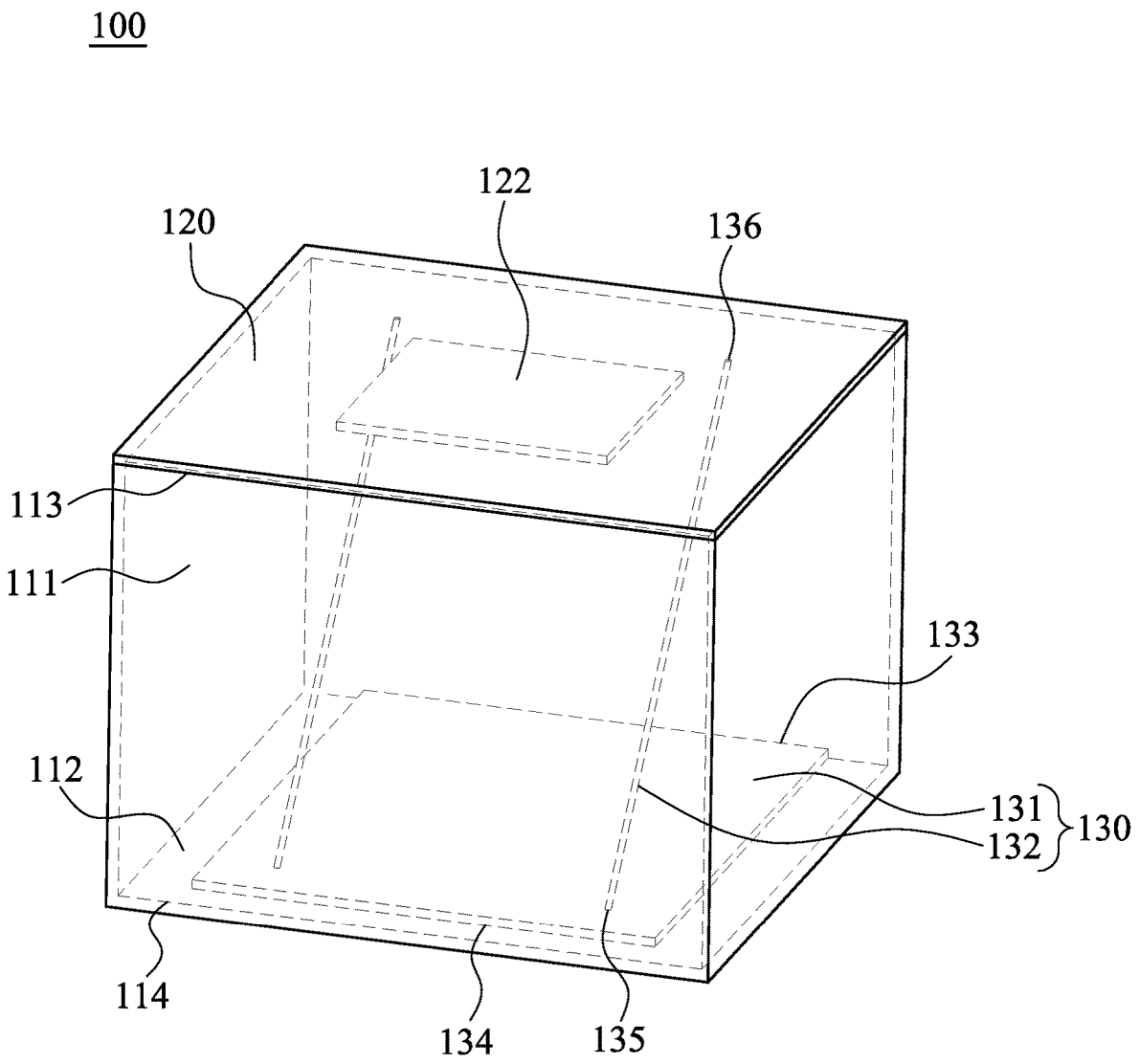
FIG. 1 is a perspective view of a parcel box according to one embodiment of the present disclosure, in which a lid is at a closed position.

Reference will now be made in detail to the present embodiments of the invention, examples of which are illustrated in the accompanying drawings. Wherever possible, the same reference numbers are used in the drawings and the description to refer to the same or like parts.

The present disclosure relates to a parcel box having a mechanism for closing a lid of the parcel box. In particular, the mechanism can drive the lid of the parcel box to close when a parcel is placed into the parcel box.

Figure 2:
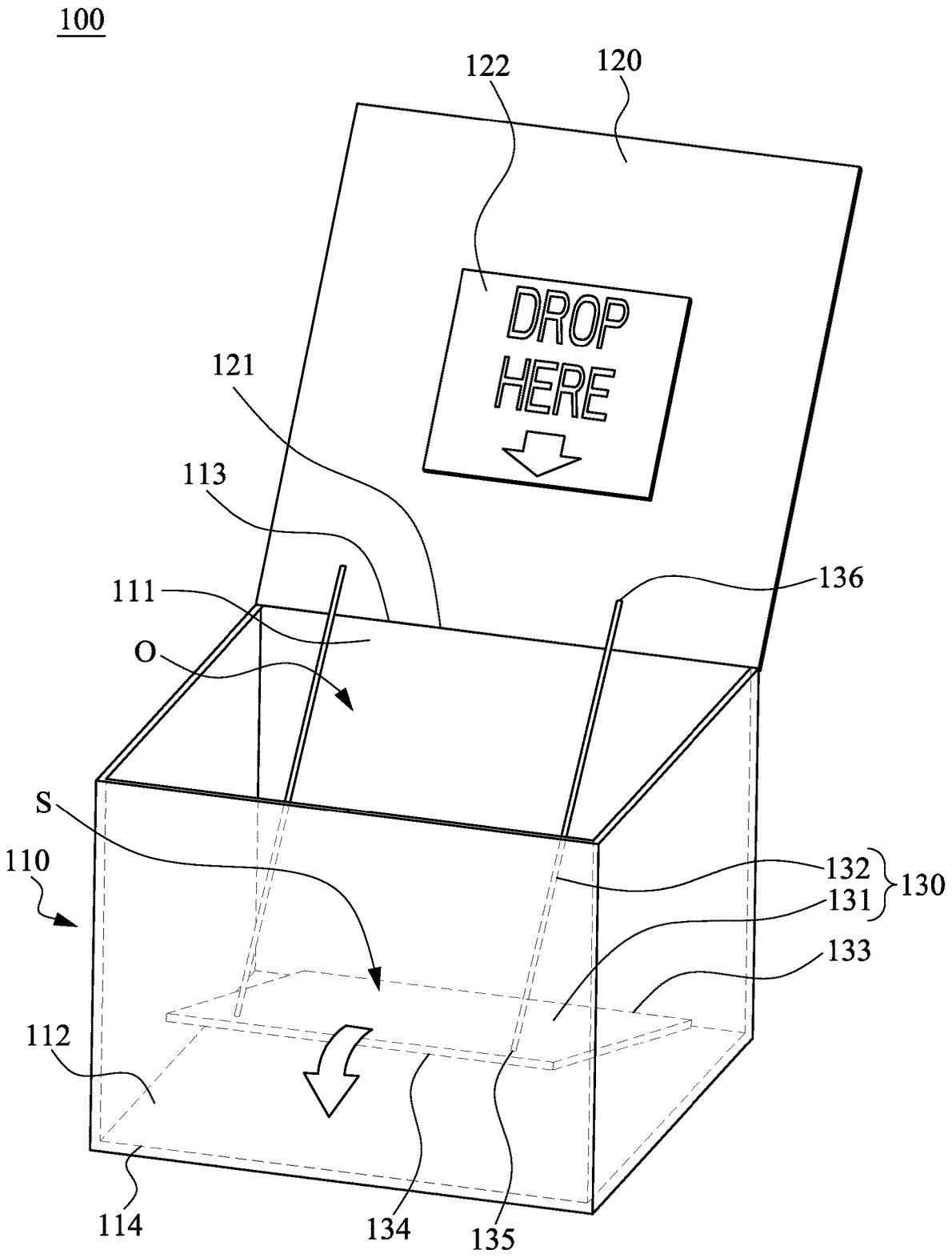
FIG. 2 is a perspective view of the parcel box of FIG. 1, in which the lid is at an open position.

FIG. 1 is a perspective view of a parcel box 100 according to one embodiment of the present disclosure, in which a lid 120 is at a closed position. FIG. 2 is a perspective view of the parcel box of FIG. 1, in which the lid 120 is at an open position. Referring to FIG. 1 and FIG. 2, the parcel box 100 has a container 110, the lid 120, and a lid-closing module 130. The container 110 has four side walls 111 and a bottom plate 112. Each of the side walls 111 has a top edge 113 and a bottom edge 114, and the four top edges 113 of the side walls 111 define an opening O. The bottom edges 114 of the side walls 111 are connected to the bottom plate 112. The bottom plate 112 and the side walls 111 define a space S. A parcel (or an object) can be placed into the space S of the container 110 through the opening O.

The lid 120 has an edge 121 pivotally connected to the top edge 113 of one of the side walls 111. Through pivotal motion, the lid 120 can move between a closed position as shown in FIG. 1 and an open position as shown in FIG. 2. When the lid 120 is at the closed position, the lid 120 covers the opening O. When the lid 120 is at the open position, the lid 120 does not cover the opening O.

The lid-closing module 130 is connected to the lid 120, and has a contacting part 131 and a flexible connector 132. In this embodiment, the contacting part 131 is a contact plate to be pressed by a parcel. The contact plate 131 has a first edge 133 and a second edge 134 opposite the first edge 133. The first edge 133 of the contact plate 131 is pivotally connected to the bottom plate 112. The second edge 134 of the contact plate 131 is connected to the flexible connector 132. The flexible connector 132 has a first end 135 and a second end 136 opposite each other. The first end 135 of the flexible connector 132 is, as mentioned, connected to the contact plate 131, and the second end 136 of the flexible connector 132 is connected to the lid 120.

When a parcel is placed into the space S of the container 110, the contact plate 131 bears the weight of the parcel and is pushed downward. Specifically, the first edge 133 of the contact plate 131 is fixed to the bottom plate 112, and the second edge 134 of the contact plate 131 pivots to the bottom plate 112 and moves downward. As a result, the contact plate 131 can pull the flexible connector 132 downward. The magnitude of motion due to rotation is greater the further away from the pivot. In other words, the distance travelled by the contact plate 131 in the downward motion increases from the first edge 133, which is pivotally connected to the bottom plate 112, to the second edge 134. In order to increase the distance by which the contact plate 131 pulls on the flexible connector 132, the first end 135 of the flexible connector 132 is connected to the second edge 134 of the contact plate 131, or a position proximal to the second edge 134 of the contact plate 131.

As the flexible connector 132 is pulled downward by the contact plate 131, the flexible connector 132 pulls the lid 120 downward from the open position to the closed position at the same time. Thereby, the lid 120 is closed on the opening O without manual operation by a user. The weight of a parcel placed into the space S of the container 110 drives the lid-closing module 130 to close the lid 120 on the opening O.

The first end 135 and the second end 136 of the flexible connector 132 can be detachable. When not expecting delivery, the flexible connector 132 can be detached from the lid 120 and/or the contact plate 131, such that the lid-closing module 130 overall is disengaged from the lid 120. In this state, the lid-closing module 130 does not drive the lid 120 to the closed position even when the contact plate 131 is pushed downward by a parcel. Thus, the parcel box 100 can be adjusted by a user to have a self-closing lid 120 or not, according to need.

In some embodiments, the container 110 of the parcel box 100 further has a signage 122 disposed on a bottom surface of the lid 120. When the lid 120 is at the open position, the bottom surface of the lid 120 and the signage 122 thereon face toward users (e.g., deliverymen) standing in front of the container 110. The signage 122 includes a word such as "parcel," "package," "drop," "here," or combinations thereof, such as "drop parcel" or "drop here." When the lid 120 is at the closed position, the bottom surface of the lid 120 and the signage 122 thereon faces toward the space S of the container 110 and is not visible from the outside of the container 110

It is to be noted that the connection relationships of the elements described above will not be repeated in the following description, and only aspects related to other types of lid-closing modules will be described.

Figure 3:
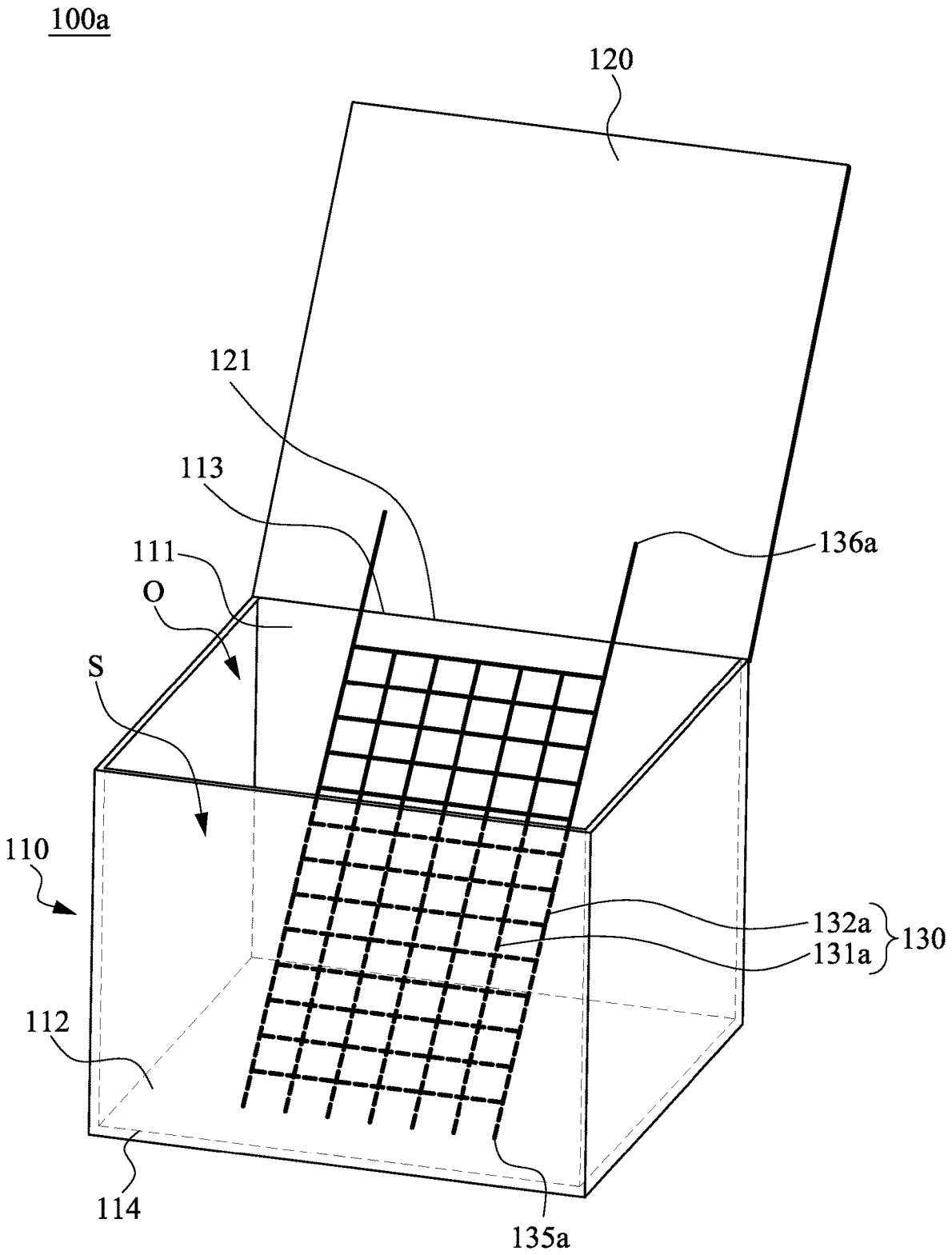
FIG. 3 is a perspective view of a parcel box according to another embodiment of the present disclosure, in which a lid is at an open position.

FIG. 3 is a perspective view of a parcel box 100*a* according to another embodiment of the present disclosure, in which the lid 120 of the parcel box 100*a* is at an open position. Referring to FIG. 3, the parcel box 100*a* includes the container 110, the lid 120, and a lid-closing module 130*a*. The difference between this embodiment and the embodiment shown in FIG. 2 is that the contacting part 131*a* of the lid-closing module 130*a* is a contact net, and the lid-closing module 130*a* includes two flexible connectors 132*a* connected to the bottom plate 112. The two flexible connectors 132*a* each have a first end 135*a* and a second end 136*a*, in which the first end 135*a* is connected to the bottom plate 112, and the second end 136*a* is connected to the lid 120. Furthermore, the contact net 131*a* is connected to and arranged between the two flexible connectors 132*a*, and is stretched by the two flexible connectors 132*a*.

In this embodiment, when a parcel is placed into the space S of the container 110, the contact net 131*a* bears the weight of the parcel and is pushed downward. The downward motion of the contact net 131*a* pulls the flexible connectors 132*a* downward. In order to obstruct the opening O as little as possible when the lid 120 is at the open position, the second ends 136*a* of the flexible connectors 132*a* can be connected to the lid 120 at a position proximal to the edge 121 of the lid 120 that is pivotally connected to the side wall 111 of the container 110. Thus, the contact net 131*a* spanning between the flexible connectors 132*a* is closer to the side wall 111 connected to the lid 120, and blocks a smaller portion of the opening O. In order to engage a greater area of the contact net 131*a* when a parcel is placed into the space S of the container 110, the first ends 135*a* of the flexible connectors 132*a* can be connected to the bottom plate 112 at a position further away from the side wall 111 connected to the lid 120. Thus, the contact net 131*a* spanning between the flexible connectors 132*a* also substantially spans from the side wall 111 connected to the lid 120 across to the opposite side wall 111, and has a greater area for engaging a parcel placed into the container 110.

As the flexible connectors 132*a* are pulled downward by the contact net 131*a*, the second ends 136*a* of the flexible connectors 132*a* pull the lid 120 downward from the open position to the closed position. Thereby, the lid 120 is closed on the opening O without manual operation by a user. The weight of a parcel placed into the space S of the container 110 drives the lid-closing module 130*a* to close the lid 120 on the opening O.

The contact net 131*a* can be detachable. When not expecting delivery, the contact net 131*a* can be detached from the flexible connectors 132*a*, such that the lid-closing module 130*a* overall is not driven by a parcel placed into the container 110. In this state, the lid-closing module 130*a* does not drive the lid 120 to the closed position even when a parcel is placed into the space S of the container 110. Thus, the parcel box 100*a* can be adjusted by a user to have a self-closing lid 120 or not, according to need.

Figure 4:
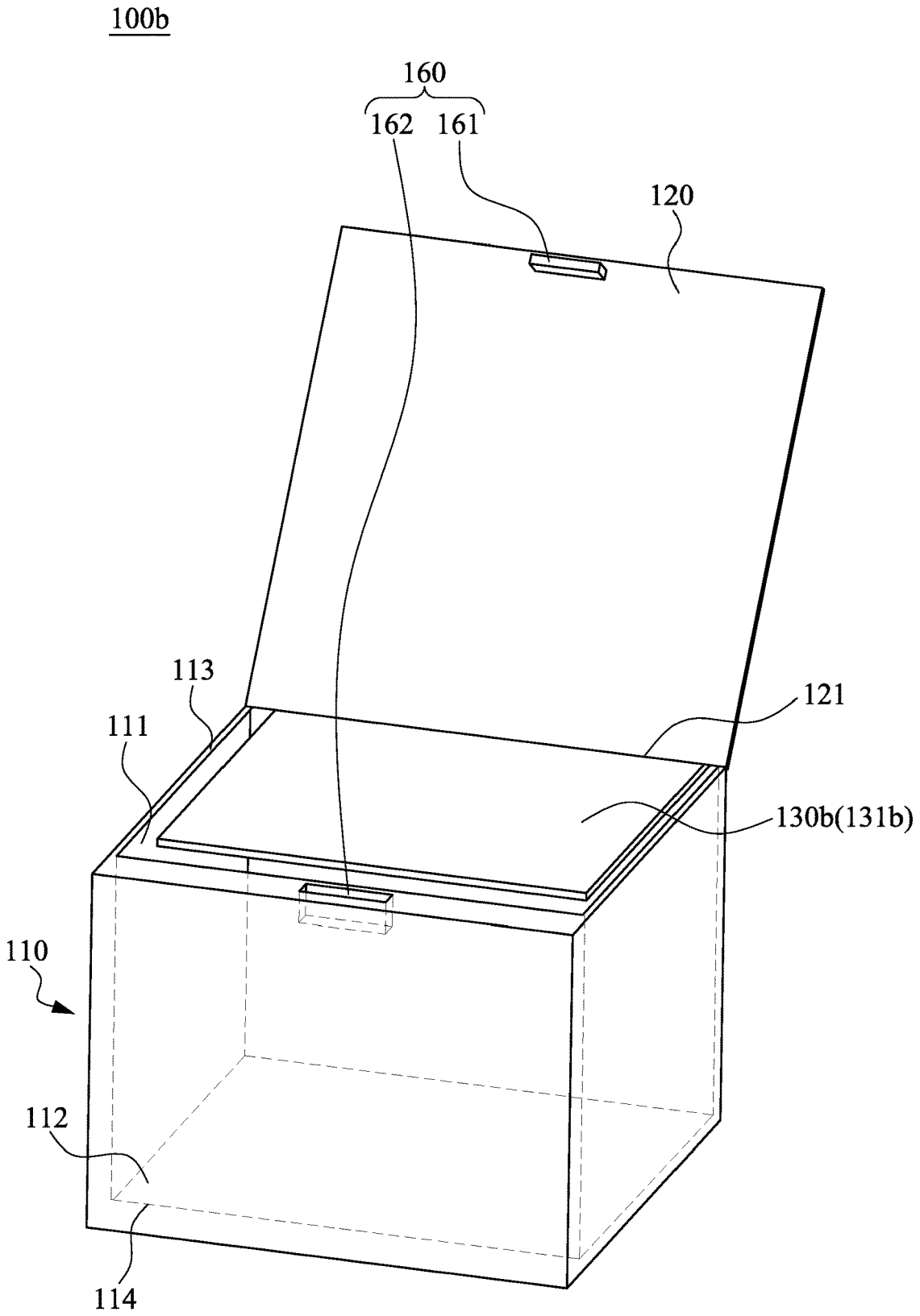
FIG. 4 is a perspective view of a parcel box according to another embodiment of the present disclosure, in which a lid is at an open position.

FIG. 4 is a perspective view of a parcel box 100*b* according to another embodiment of the present disclosure, in which the lid 120 of the parcel box 100*b* is at an open position. Referring to FIG. 4, the parcel box 100*b* includes the container 110, the lid 120, and a lid-closing module 130*b*. The difference between this embodiment and the embodiment shown in FIG. 2 is that the contacting part 131*b* of the lid-closing module 130*b* is a contact plate that is directly connected to the lid 120.

In order to engage a parcel placed into the container 110 through the opening O, the contact plate 131*b* is connected to the lid 120 at a position proximal to the edge 121 of the lid 120 that is pivotally connected to the side wall 111 of the container 110. The contact plate 131*b* covers at least a portion of the opening O when the lid 120 is at the open position. In this embodiment, the contact plate 131*b* is fixed to the lid 120, and thus an angle between the contact plate 131*b* and the lid 120 is fixed. In other words, the contact plate 131*b* and the lid 120 are simultaneously pivoted on the top edge 113 of the side wall 111. When a parcel is placed into the space S of the container 110 through the opening O, the contact plate 131*b* bears the weight of the parcel and is pushed downward. The downward motion of the contact plate 131*b* pulls the lid 120 downward at the same time. Thereby, the lid 120 is closed on the opening O without manual operation by a user. The weight of a parcel placed into the container 110 through the opening O drives the lid-closing module 130*b* to close the lid 120 on the opening O. In some embodiments, an angle between the lid 1200 and the contact plate 131*b* is substantially ninety degrees, such that the contact plate 131*b* can be substantially parallel and proximal to the sidewall 111 of the container 110 when the lid 120 is in plane with the opening O of the container 110 at the closed position.

In this embodiment, the parcel box 100*b* further has a self-locking lock 160. The self-locking lock 160 includes two coupling parts 161, 162 respectively located on the lid 120 and one of the side walls 111. The two coupling parts 161, 162 are configured to self-lock, or automatically engage, when they are pressed against each other. In some embodiments, once locked, the self-locking lock 160 can be unlocked by a key. In some embodiments, once locked, the self-locking lock 160 can be unlocked by an electronic unit by inputting a digital code on the self-locking lock 160 or at a remote device.

Figure 5:
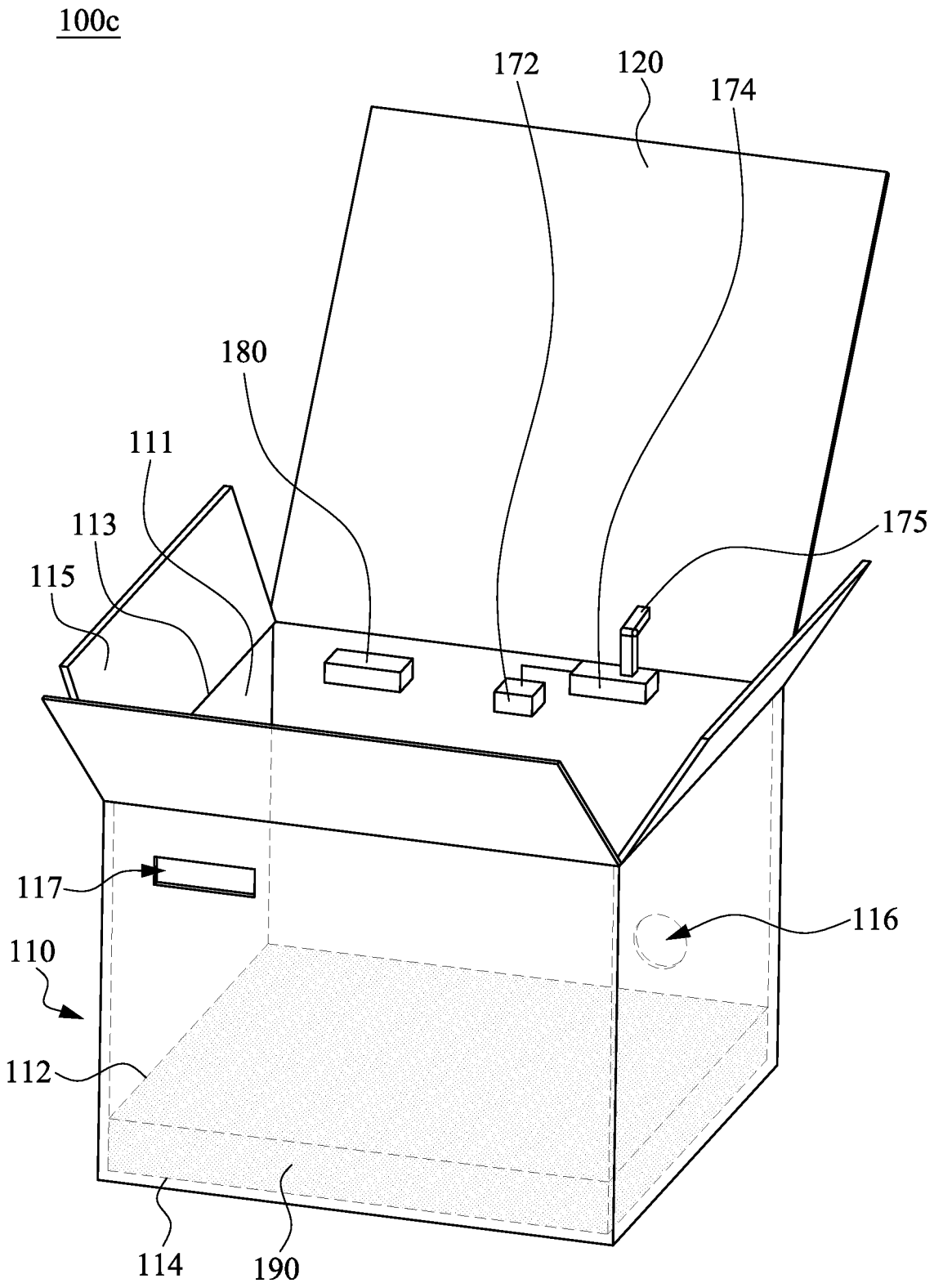
FIG. 5 is a perspective view of a parcel box according to another embodiment of the present disclosure, in which a lid is at an open position.

FIG. 5 is a perspective view of a parcel box 100*c* according to another embodiment of the present disclosure, in which the lid 120 of the parcel box 100*c* is at an open position. Referring to FIG. 5, the parcel box 100*c* includes the container 110, the lid 120, a motion sensor 172, and a motorized unit 174. The container 110 and the lid 120 of the parcel box 100 are similar to those described above. The motion sensor 172 is configured to sense a motion of an object placed into the space S of the container 110. The motion sensor 172 is electrically connected to the motorized unit 174. The motorized unit 174 drives the lid 120 to cover the opening O when the motion sensor 172 senses motion of an object placed into the space S of the container 110. For example, the motorized unit 174 may have an extendable holder 175 connected to the lid 120.

The parcel box 100*c* further has protruding plates 115. Each of the protruding plates 115 is connected to one of the side walls 111 not connected to the lid 120. Specifically, each of the protruding plates 115 extends from the top edge 113 of the respective side wall 111, in a direction up and away from the opening O. The protruding plates 115 prevent animals such as pets or wild creatures from jumping or climbing into the container 110, and accidentally closing the lid 120. It is to be noted that the protruding plates 115 shown in FIG. 5 can be applied to any one of the embodiments shown in FIGS. 1 to 4. When the protruding plates 115 are connected to the side walls 111 of the container 110 of FIGS. 1 to 4, the protruding plates 115 can prevent animals from jumping or climbing into the container 110 of FIGS. 1 to 4, and accidentally triggering the self-closing modules 130, 130*a*, and 130*b* of FIGS. 1 to 4 to close the lid 120.

In some embodiments, the container 110 of the parcel box 100*c* further has at least one hole 116 configured to be passed through by a bolt. The hole 116 can be formed at the bottom plate 112, or any of the side walls 111. A bolt can be used to secure and fix the parcel box 100*c* to a wall or the ground, and can be disengaged only from inside the container 110. Thus, in order to disengage the bolt, the lid 120 must be open. When the lid 120 is closed on the opening O and locked, a person cannot move the parcel box 100*c* without first unlocking and opening the lid 120. It is to be noted that the hole 116 shown in FIG. 5 can be applied to any one of the embodiments shown in FIGS. 1 to 4. When the container 110 of FIGS. 1 to 4 further has the hole 116, a bolt can pass through the hole 116 to secure and fix the parcel boxes 100, 100*a*, and 100*b* to a wall or the ground, and can be disengaged only from inside the container 110.

In some embodiments, the container 110 of the parcel box 100*c* further has a weight unit 190 disposed in the space S of the container 110. The weight unit 190 is heavy such that the parcel box 100*c* becomes difficult to move. The weight unit 190 can be filled with sand, water, or a combination thereof. In some embodiments, the bottom plate 112 includes the weight unit 190. It is to be noted that the weight unit 190 shown in FIG. 5 can be applied to any one of the embodiments shown in FIGS. 1 to 4.

In some embodiments the container 110 of the parcel box 100*c* further has a slot 117 formed on one of the side walls 111. A height of the slot 117 is less than three centimeters, such that letters, envelopes, postcards, and the like can pass there-through, but bigger parcels and a human hand cannot. Thus, the parcel box 100*c* can continue to accept delivery of smaller mails such as letter, envelopes and postcards even when the lid 120 is closed and locked. It is to be noted that the slot 117 shown in FIG. 5 can be applied to any one of the embodiments shown in FIGS. 1 to 4.

In some embodiments the container 110 of the parcel box 100*c* further has a GPS tracker 180 disposed in the space S of the container 110. Specifically, the GPS tracker 180 is disposed on an inner surface of one of the side walls 111. The GPS 180 tracker can be used to track the location of the parcel box 100*c*, which can be useful when the parcel box 100*c* is stolen. It is to be noted that the GPS tracker 180 shown in FIG. 5 can be applied to any one of the embodiments shown in FIGS. 1 to 4.

In some embodiments of the present disclosure, the lid-closing module is a hands-free closure mechanism that automatically closes the lid on the parcel box when a user (e.g. deliveryman) or an unmanned flying drone simply drops a parcel into the parcel box from a space above the parcel box. Furthermore, a self-locking lock may be provided such that the parcel box is automatically locked when the lid is closed thereupon. Thusly, by simply dropping a parcel into the parcel box from a space above the parcel box, and without performing any additional step, the lid can automatically close upon and be locked to the parcel box.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A parcel box comprising:

a container having four side walls and a bottom plate, wherein the four side walls each have a top edge and a bottom edge, the bottom plate is connected to the bottom edges of the side walls, the top edges of the side walls define an opening, and the side walls and the bottom plate define a space;

a lid having an edge pivotally connected to the top edge of one of the side walls, and configured to cover the opening at a closed position, and uncover the opening at an open position;

a motion sensor configured to sense a motion of placing an object into the space;

a motorized unit electrically connected to the motion sensor, and configured to drive the lid to the closed position when the motion sensor senses the motion; and protruding plates, each connected to one of the three top edges of the three side walls not connected to the lid, wherein each of the protruding plates extends from the top edge of the respective side wall in a direction up and away from the opening.

2. The parcel box of claim 1, wherein one of the bottom plate and the side walls has a hole configured to be passed through by a bolt.

3. The parcel box of claim 1, wherein the bottom plate comprises a weight unit having sand, water, or a combination thereof therein.

4. The parcel box of claim 1, wherein one of the side walls has a slot having a height of less than three centimeters.

5. The parcel box of claim 1, further comprising a GPS tracker on an inner surface of one of the side walls.

* * * * *